US007372477B2

(12) United States Patent
Yokoyama

(10) Patent No.: US 7,372,477 B2
(45) Date of Patent: May 13, 2008

(54) THERMAL HEAD AND MANUFACTURING METHOD THEREOF

(75) Inventor: Shinya Yokoyama, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 177 days.

(21) Appl. No.: 11/436,169

(22) Filed: May 17, 2006

(65) Prior Publication Data

US 2006/0262164 A1 Nov. 23, 2006

(30) Foreign Application Priority Data

May 18, 2005 (JP) ..... 2005-145595

(51) Int. Cl.
*B41J 2/335* (2006.01)

(52) U.S. Cl. ..... 347/208

(58) Field of Classification Search ..... 347/171, 347/200, 201, 202, 203, 204, 205, 206, 207, 347/208

See application file for complete search history.

(56) References Cited

U.S. PATENT DOCUMENTS 5,477,266 A * 12/1995 Shirakawa ..... 347/208
6,151,054 A * 11/2000 Shimizu ..... 347/204
6,304,280 B1 * 10/2001 Yamade et al. ..... 347/203

FOREIGN PATENT DOCUMENTS

JP A1 2004-017523 1/2004
JP A2 2004-155160 6/2004

* cited by examiner

*Primary Examiner*—K. Feggins
(74) *Attorney, Agent, or Firm*—Brinks Hofer Gilson & Lione

(57) ABSTRACT

A method for manufacturing a thermal head is provided which includes the steps of forming a resistor layer and an insulating barrier layer, patterning the above two layers to form aligned heating resistors, forming a solid electrode layer over the heating resistors and the like, and partly removing the solid electrode layer to form opening portions and electrode layers for supplying electricity to the heating resistors. In the patterning step, part of the resistor layer and part of the insulating barrier layer, which are outside a heat generating area, are simultaneously removed to form the heating resistors having a planar U shape composed of a pair of effective heating portions and a connection portion connecting the above pair, the effective heating portions and the connection portion each having a predetermined length and width. The length of the connection portion is set to 5 μm or less.

9 Claims, 7 Drawing Sheets

THERMAL HEAD AND MANUFACTURING METHOD THEREOF

BACKGROUND OF THE INVENTION

1. Field of the Invention

The present invention relates to a thermal head mounted on a thermal-transfer printer or the like and a manufacturing method of the thermal head.

2. Description of the Related Art

FIG. 6A is a cross-sectional view showing a thermal head 100 having a so-called folded electrode structure, and FIG. 6B is a plan view of the thermal head 100 (an abrasion-resistance protective layer is excluded). The thermal head 100 includes a heat dissipation substrate 102, and on the heat dissipation substrate 102, the thermal head 100 also includes a heat storage layer 103, a plurality of heating resistors 105 (105*a* and 105*b*) which generate heat by electricity supply, separate electrodes 107 connected to the respective heating resistors 105, a common electrode 108 commonly connected to the heating resistors 105, U-shaped folded electrodes 111 each connected to one end of a pair of heating resistors 105*a* and 105*b* which are disposed adjacent to each other, and an abrasion-resistance protective layer 110. In this thermal head 100, the pair of heating resistors 105*a* and 105*b* connected to each other with the folded electrode 111 forms one printing dot portion.

The thermal head 100 is formed, for example, by the following process.

First, a resistor layer 104 and an Al electrode layer E are formed over the heat storage layer 103 provided on the surface of the heat dissipation substrate 102. Next, part of the Al electrode layer E and part of the resistor layer 104 are removed so as to form patterns of the folded electrodes, the separate electrodes, and the common electrode, which are to be formed. The Al electrode layer E is formed to have a thickness of approximately 1 μm in order to decrease the electrode resistance (in order to suppress the increase in electrode resistance caused by decrease in head size). By this patterning, a width dimension W' of the heating resistor is determined. Subsequently, part of the Al electrode layer E is removed so as to form opening portions a through which the surface of the resistor layer 104 is exposed. Areas of the surface of the resistor layer 104, which are exposed through the openings, each form the heating resistor 105, and a length dimension L' of the heating resistor is determined by the opening portion α. The Al electrode layer E is separated by each opening portion a into the U-shaped folded electrode 111, which is connected to one end side of the pair of the adjacent heating resistors 105 (105*a* and 105*b*), and the separate electrode 107 and the common electrode 108, which are connected to the other end side of the pair of the adjacent heating electrodes 105*a* and 105*b* and which extend in the same direction. Next, the abrasion-resistance protective layer 110 is formed so as to cover the heating resistors 105, the folded electrodes 111, the separate electrodes 107, and the common electrode 108. Since the thickness of the Al electrode layer E is large, such as approximately 1 μm, steps are formed at the two ends of the opening portion α, that is, at the boundaries of the heating resistor 105 with the folded electrode 111, the separate electrode 107, and the common electrode 108, and these steps form a step portion 110*a* in the surface of the abrasion-resistance protective layer 110. When the steps are present in the vicinity of the heating resistor 105, since contact efficiency between a print medium and the heating resistance 105 is degraded, the step portion 110*a* of the abrasion-resistance protective layer 110 is polished so as to smooth the contact surface with the print medium. Accordingly, the thermal head 100 can be obtained.

The resistance of the above heating resistor 105 is largely dependent on the planar shape (aspect ratio L/W) thereof. However, in order to determine the planar shape of the heating resistor 105 in a manufacturing process which has been performed, since patterning must be performed twice respectively for the length dimension L' and for the width dimension W', the deviation is generated between pattering steps, and thereby the resistance of the heating resistor 105 varies. Accordingly, a high-performance thermal head has been desired which has small variation in resistance between heating resistors by accurately determining the planar shapes thereof.

SUMMARY OF THE INVENTION

The present invention was made in consideration of the problem described above, and an object of the present invention is to provide a high-performance thermal head which can accurately determine the planar shapes of resistor layers and a manufacturing method of the thermal head.

The present invention relates to a technique in which the width dimension and the length dimension of the resistor layer are simultaneously determined so as to improve the patterning accuracy.

That is, according to one aspect of the present invention, there is provided a thermal head comprising a resistor layer which generates heat when electricity is supplied thereto, an insulating barrier layer covering the surface of the resistor layer so as to determine a planar size of a heat generating area; and an electrode layer which is overlaid on the insulating barrier layer and which supplies electricity to the resistor layer. In the thermal head described above, the resistor layer and the insulating barrier layer each have a planar U shape, the resistor layer is present only under the insulating barrier layer and includes a pair of effective heating portions each having a predetermined length dimension and a predetermined width dimension and a connection portion connecting the pair of effective heating portions at an end thereof, and the electrode layer includes a separate electrode and a common electrode, which are connected to the pair of effective heating portions at one end side of the resistor layer in the longitudinal direction, and also includes a folded electrode connected to the pair of effective heating portions and the connection portion at the other end side of the resistor layer in the longitudinal direction.

The connection portion of the resistor layer preferably has a length dimension of 5 μm or less. When the connection portion has a length dimension in this range, even when the effective heating portions, which form a pair, are connected with the connection portion, the connection portion will not adversely influence the heat distribution of the pair of effective heating portions, and a heat distribution similar to that obtained when the above effective heating portions are separately formed can be obtained. In addition, since the connection portion is present, the folded electrode can be connected to the continuous surface of the resistor layer with the insulating barrier layer provided therebetween, and as a result, the formation of a pocket recess portion causing printing damage can be prevented.

Two end surfaces of the resistor layer in the longitudinal direction are each preferably a tapered surface along which the thickness of the resistor layer is decreased toward the end side. Owing to this structure, a large contact area between the resistor layer and the electrode layer can be ensured, and as a result, electricity can be surely supplied to the resistor layer. Hence, resistance defects caused by insufficient electrical contact can be avoided.

The folded electrode preferably has a planar U shape and includes a pair of parallel electrode portions, which is parallel to the pair of effective heating portions of the heating resistor and which extends onto the insulating barrier layer, and a connection electrode portion which connects edges of the pair of parallel electrode portions on the insulating barrier layer, the edges being located at the resistor layer side.

According to another aspect of the present invention, there is provided a method for manufacturing a thermal head, comprising the steps of sequentially forming a solid resistor layer and a solid insulating barrier layer over an entire surface of a heat storage layer, patterning the solid resistor layer and the solid insulating barrier layer to form at least one resistor layer and at least one insulating barrier layer, respectively, each having a planar U shape, forming a solid electrode layer over the insulating barrier layer and the heat storage layer, and removing part of the solid electrode layer to form at least one opening portion through which the insulating barrier layer is exposed and to form electrode layers overlaid on the insulating barrier layer at one side and the other side of the opening portion for supplying electricity to the resistor layer. In the method described above, in the patterning step, part of the solid resistor layer and part of the solid insulating barrier layer, which are outside a heat generating area, are simultaneously removed so as to simultaneously determine the width dimension and the length dimension of the resistor layer and those of the insulating barrier layer.

The resistor layer preferably has a U shape and includes a pair of effective heating portions each having a predetermined width dimension and a predetermined length dimension and a connection portion connecting the pair of effective heating portions at an end thereof, and the length dimension of the connection portion is preferably set to 5 μm or less. When the length dimension of the connection portion is in the above range, the folded electrode can be provided without generating a pocket recess portion which causes printing damage, and in addition, although the connection portion is provided, three will be no adverse influence at all on the heat distribution of the pair of effective heating portions.

In the patterning step, two end surfaces of the resistor layer in the longitudinal direction are each preferably formed to be a tapered surface along which the thickness of the resistor layer is decreased toward the end side. By the structure described above, a large contact area between the resistor layer and the electrode layer can be ensured, and as a result, electricity can be surely supplied to the resistor layer.

In the above patterning step, part of the solid resistor layer and part of the solid insulating barrier layer, which are outside a heating area, are preferably simultaneously removed by dry etching.

In particular, the electrode layers may include at least one separate electrode and at least one common electrode, which are connected to the pair of effective heating portions at one end side of the resistor layer in the longitudinal direction, and may also include at least one folded electrode connected to the pair of effective heating portions and the connection portion at the other end of the resistor layer in the longitudinal direction. In addition, the folded electrode preferably has a planar U shape and includes a pair of parallel conductive portions, which is parallel to the pair of effective heating portions of the heating resistor and which extends onto the insulating barrier layer, and an electrode which connect the pair of parallel conductive portions at least on the insulating barrier layer.

According to the present invention, a high-performance thermal head which can accurately determine the planar shapes of resistor layers and a manufacturing method of the thermal head can be provided.

DESCRIPTION OF THE PREFERRED EMBODIMENTS

Figure 1:
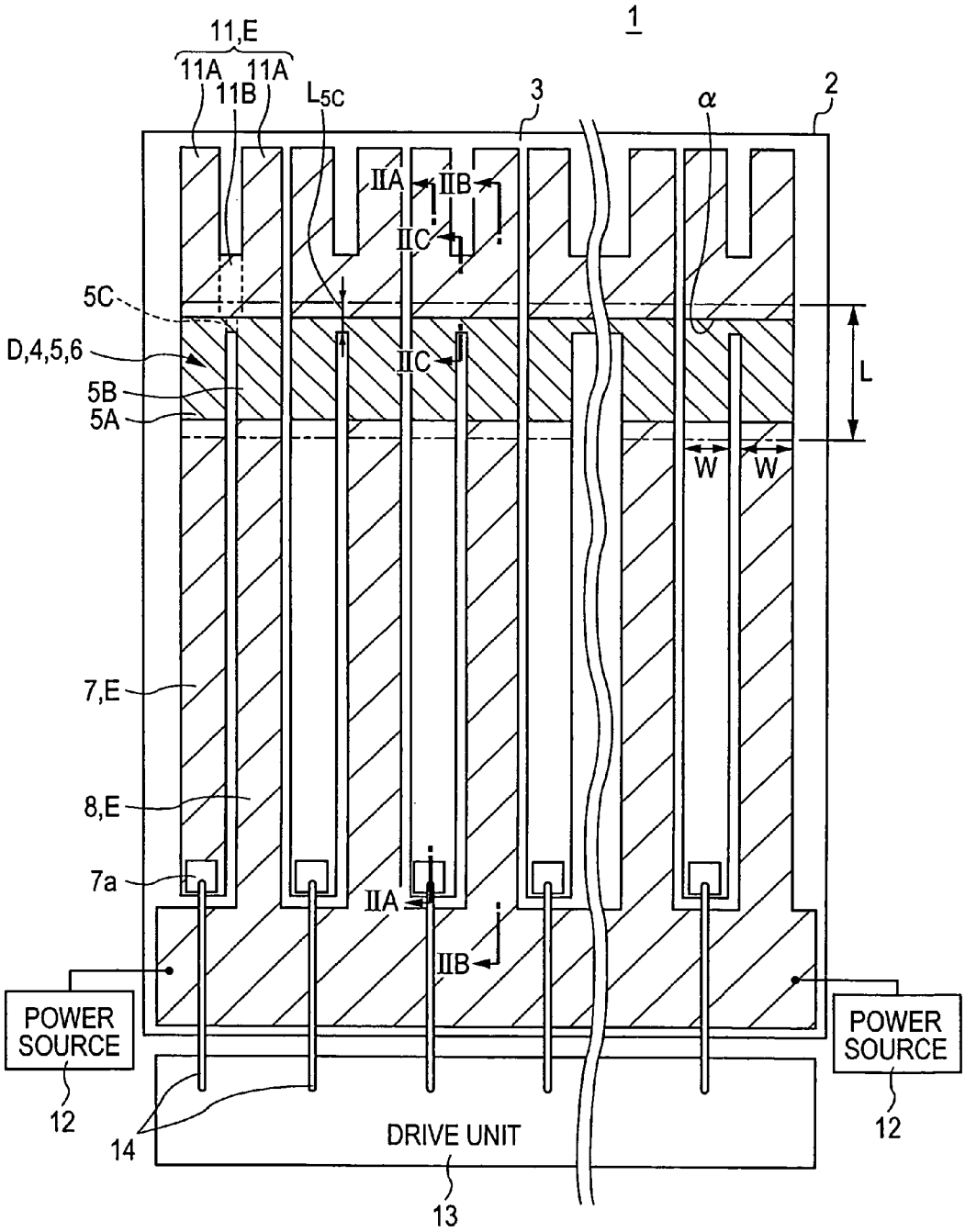
FIG. 1 is a plan view showing a thermal head (excluding a protective layer) according to one embodiment of the present invention.

FIGS. 1 to 5B show a thermal head according to one embodiment of the present invention. FIG. 1 is a plan view of a thermal head 1 (excluding an abrasion-resistance protective layer), and FIGS. 2A to 2C are cross-sectional views of the thermal head 1. The thermal head 1 has a plurality of printing dots D aligned with regular intervals in the lateral direction in FIG. 1, and printing operation is performed by applying heat of each printing dot D to heat-sensitive paper or an ink ribbon.

The thermal head 1 includes a heat dissipation substrate 2, a heat storage layer 3 provided on the surface thereof and formed of a heat insulating material such as a glass, a plurality of heating resistors 5 formed on the heat storage layer 3, a plurality of insulating barrier layers 6 which cover the surfaces of the heating resistors 5 and which determine the planar size thereof (length dimension L and width dimension W), an Al electrode layer E (including separate electrodes 7, a common electrode 8, and folded electrodes 11) supplying electricity to the heating resistors 5, and an abrasion-resistance protective layer 10 covering the insulating barrier layers and the Al electrode layer E. One printing dot D is formed of one heating resistor 5.

The heat storage layer 3 is a flat glazed layer having a uniform thickness and provided over the entire surface of the heat dissipation substrate 2. The insulating barrier layer 6 is formed of an insulating material such as $SiO_2$, SiON, or SiAlON.

The heating resistors 5 are each formed of a resistor layer 4 which has a planar U shape and which is partly formed on the heat storage layer 3 using a cermet material such as $Ta_2N$ or Ta—$SiO_2$. The heating resistor 5 includes a pair of rectangular effective heating portions 5A and 5B each having a length dimension L and a width dimension W and a connection portion 5C connecting the pair of effective heating portions 5A and 5B. The resistor layer 4 is only present in a heating area, that is, is only present under the insulating barrier layer 6. A length dimension $L_{5C}$ of the connection portion 5C is set to 5 μm or less, and when electricity is supplied to the heating resistor 5 via the Al electrode layer E, heat generation from the connection portion 5C is small as compared to that from the pair of effective heating portions 5A and 5B and can be ignored. Hence, although the adjacent effective heating portions 5A and 5B are connected to each other with the connection portion 5C provided therebetween, printing performance is not influenced thereby, and performance can be obtained which is similar to that obtained in the case in which the effective heating portions 5A and 5B are separately provided (are not connected to each other). The thermal head 1 performs printing operation by heat generated from the pair of the effective heating portions 5A and 5B of the heating resistors 5. In addition, although a recess is formed at one end portion of the pair of effective heating portions 5A and 5B by the connection portion 5C, the depth of this recess is small, such as approximately 0.2 μm, which is approximately equivalent to the thickness of the resistor layer 4, and hence can be ignored.

Figure 2A:
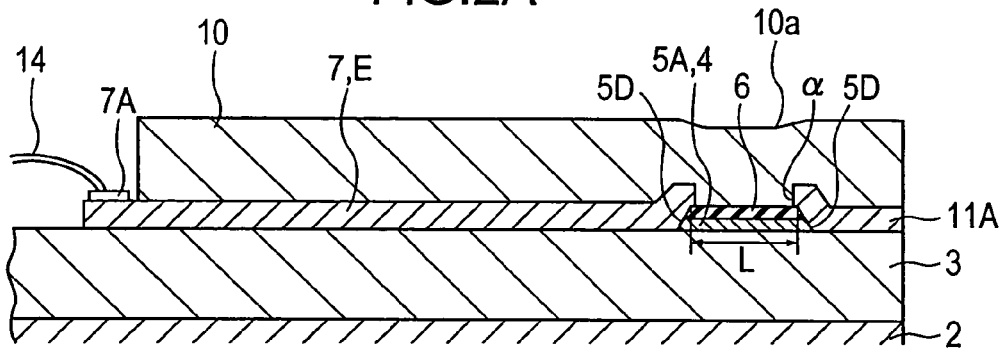
FIG. 2A is a cross-sectional view of the thermal head taken along a line IIA-IIA in FIG. 1.
Figure 2B:
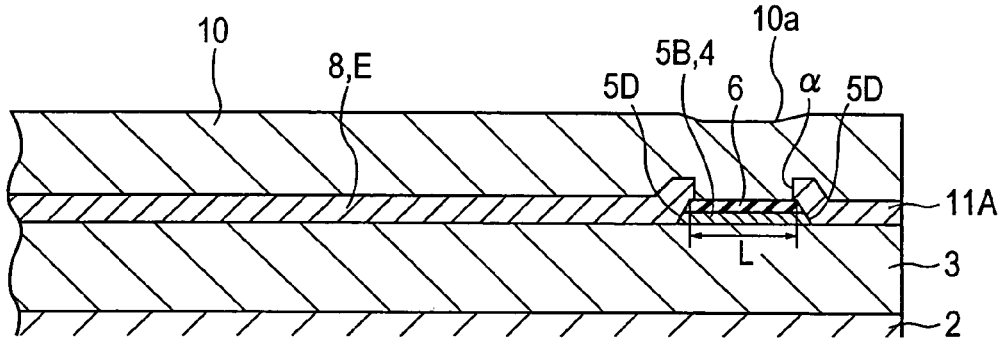
FIG. 2B is a cross-sectional view of the thermal head taken along a line IIB-IIB in FIG. 1.
Figure 2C:
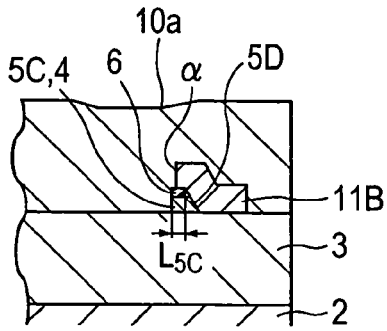
FIG. 2C is a cross-sectional view of the thermal head taken along a line IIC-IIC in FIG. 1.

In addition, as shown in FIGS. 2A and 2B, the heating resistors 5 each have two tapered end surfaces along which the thickness of the heating resistor is gradually decreased to the end sides (to the Al electrode layer E side), and by this tapered surfaces, electrical conduction with the Al electrode layer E is ensured. The Al electrode layer E has the folded electrode 11 connected to the effective heating portions 5A and 5B at one end of the heating resistor 5 and to the connection portion 5C, the separate electrode 7 connected to the effective heating portion 5A at the other end of heating resistor 5, and the common electrode 8 connected to the effective heating portion 5B at the other end of the heating resistor 5. These folded electrode 11, the separate electrode 7, and the common electrode 8 can be used for high-speed printing operation in which a large current is applied at very short intervals such as approximately several hundred microseconds so that the heating resistor 5 is alternately placed in an ON state (electricity supply) and an OFF state (no electricity supply).

The folded electrode 11 has a planar U shape facing to a side opposite to the heating resistor 5 by 180° and includes a pair of parallel electrode portions 11A parallel to the pair of effective heating portions 5A and 5B of the heating resistor 5 and a connection electrode portion 11B connecting the pair of parallel electrode portions 11A. The pair of parallel electrode portions 11A is overlaid on the insulating barrier layer 6 and extends to one end of the pair of effective heating portions 5A and 5B of the heating resistor 5. The width dimension of the pair of parallel electrode portions 11A is approximately equivalent to the width dimension of the pair of effective heating portions 5A and 5B. The connection electrode portion 11B is also overlaid on the insulating barrier layer 6 and extends to the connection portion 5C of the heating resistor 5 so as to linearly connect edges of the pair of parallel electrode portions 11A at the heating resistor 5 side. In this folded electrode 11, the dimension in the longitudinal direction overlaid on the insulating barrier layer 6 is smaller than the length dimension $L_{5C}$ of the connection portion 5C of the heating resistor 5, and hence the pair of parallel electrode portions 11A is not connected to the side surfaces of the pair of effective heating portions 5A and 5B. When the pair of parallel electrode portions 11A is not connected to the side surfaces of the pair of effective heating portions 5A and 5B, the effective heating portions 5A and 5B are not short-circuited via the folded electrode 11, and hence the variation in resistance of the heating resistor 5 (the effective heating portions 5A and 5B) caused by a leak current can be suppressed. In this case, although a recess having a depth approximately equivalent to the thickness of the folded electrode 11 (the Al electrode layer E) is formed in a region surrounded by the pair of parallel electrode portions 11A and the connection electrode 11B of the folded electrode 11, since this recess is open in the feeding direction of a print medium, when the recess is formed in the abrasion-resistance protective layer 10 by transfer, dust generated by polishing and the like may not remain on the surface of the abrasion-resistance protective layer 10 at all.

Figure 6A:
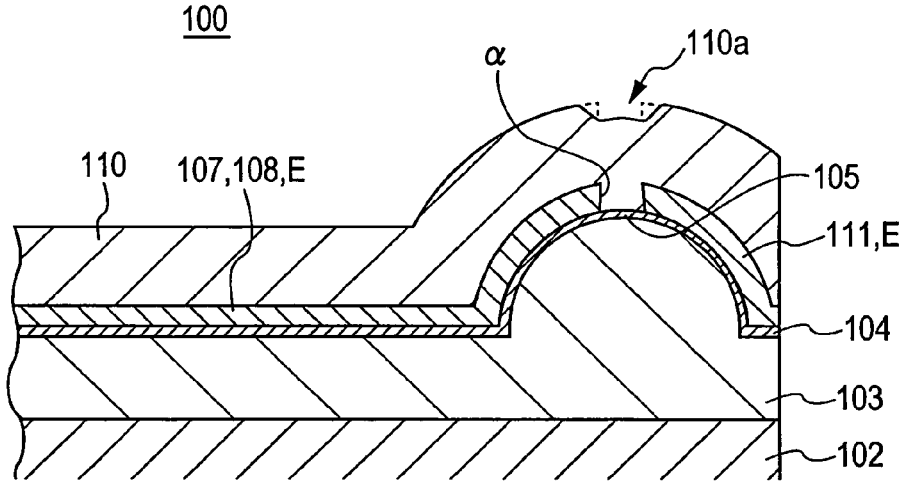
FIG. 6A PRIOR ART
FIG. 6A is a cross-sectional view of a related thermal head having a folded electrode structure.
Figure 6B:
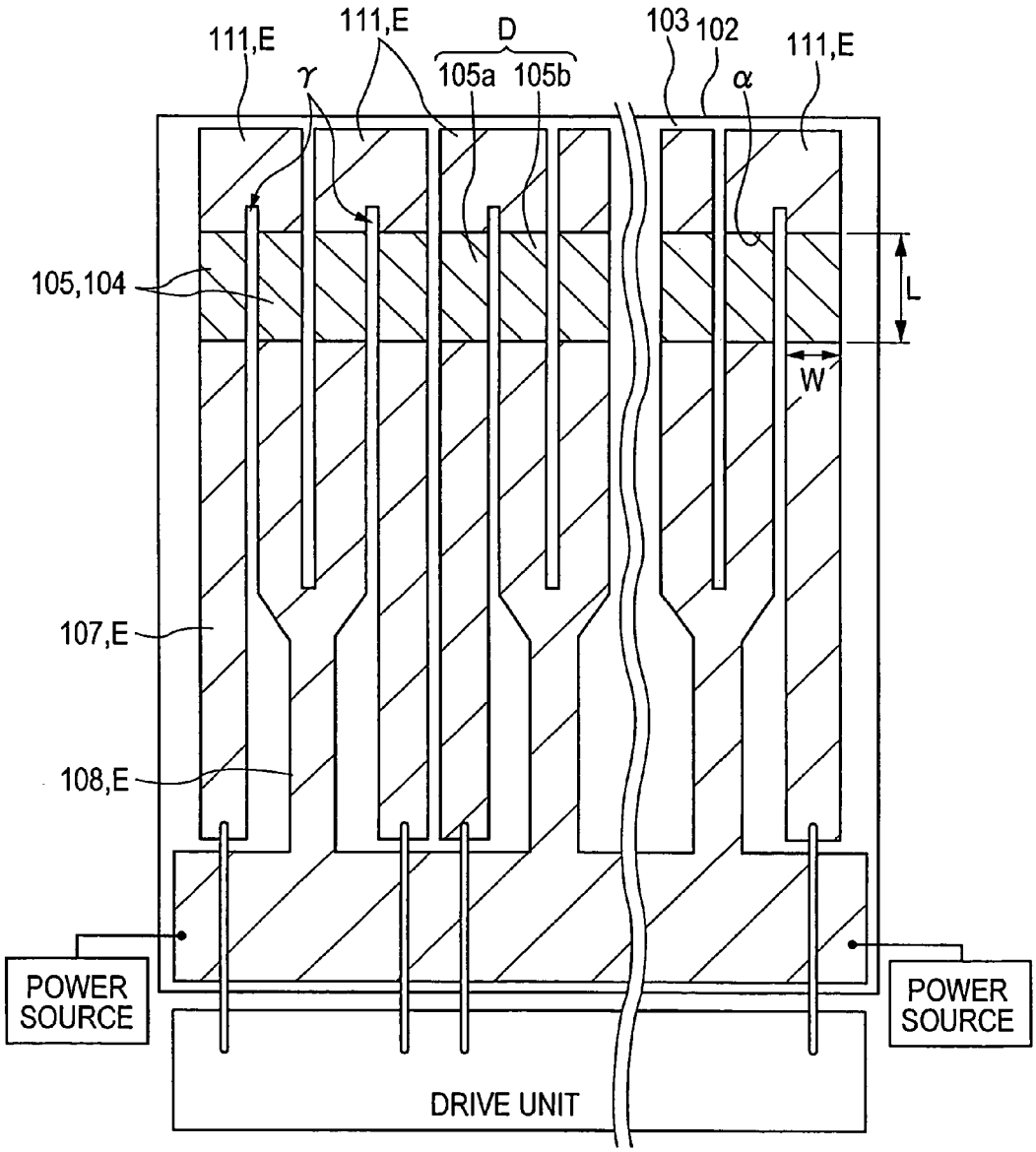
FIG. 6B PRIOR ART
FIG. 6B is a plan view of the related thermal head shown in FIG. 6A.

In the related folded electrode structure (shown in FIG. 6), a pocket recess portion, which corresponds to a pocket γhaving a depth of 1 μm or more and formed in a recess region of the folded electrode 111, is formed in the abrasion-resistance protective layer 110 by transfer, and this pocket recess portion is a recess closed in the feeding direction of a print medium. Hence, when the step portion 110*a* of the abrasion-resistance protective layer 110 is polished, for example, dust generated thereby may be caught in the pocket recess portion of the abrasion-resistance protective layer 110, or dust of a print medium or dust on the rear surface of an ink ribbon may be trapped in the pocket recess portion; hence, printing damage may occur in printing in some cases. In order to prevent the printing damage, as a first countermeasure, it is considered that the pocket recess portion is simultaneously removed when the step portion 110*a* of the abrasion-resistance protective layer 110 is polished; however, the pocket portion is difficult to be totally removed. In addition, as a second countermeasure, it is considered to decrease the thickness of the Al electrode layer E forming the folded electrode 111 so as to form a shallow pocket recess portion; however, when the thickness of the Al electrode layer E is decreased, an electrode resistance is increased. In particular, in recent years, since the electrode area has been decreased due to the rapid trend toward the decrease in head size, when the thickness of the electrode is decreased, the electrode resistance is considerably increased, and as a result, printing quality of the head is degraded. As a third countermeasure, instead of the U-shaped folded electrode 111, it is considered that a rectangular folded electrode is formed covering one end of the pair of heating resistors 105*a* and 105*b* and the space provided therebetween so as to eliminate the pocket recess portion. However, when the folded electrode is formed even in the space between the pair of the heating resistors 105*a* and 105*b* which is formed at one end thereof, a leak current is generated since the folded electrode is brought into contact with the side surfaces of the heating resistors 105*a* and 105*b*, and as a result, the resistance of the heating resistor 105 varies due to this leak current. However, according to the heating resistor 5 and the folded electrode 11 of this embodiment, the problems described above can be totally solved.

The separate electrode 7 is an electrode for separately supplying electricity to the corresponding heating resistor 5 and is formed of a belt-shaped electrode extending in the longitudinal direction of the heating resistor 5. This separate electrode 7 is connected to a drive unit 13 via an electrode pad 7*a* used for wire bonding which is provided at a side opposite to the heating resistor side. The drive unit 13 is provided separately from the heat dissipation substrate 2 and includes electrode pads wire-bonded to the respective separate electrodes 7, switching elements (drive ICs) each switching between supply and non-supply of electricity to the separate electrode 7, exterior connection terminals and the like. FIG. 1 is a schematic view showing the structure of the thermal head 1, and wires 14 connecting the separate electrodes 7. The respective electrode pads of the drive unit 13 are provided at very small intervals, such as approximately 50 μm.

The abrasion-resistance protective layer 10 is formed, for example, of an abrasion-resistance material, such as SiAlON or $Ta_2O_5$, and protects the insulating barrier layers 6 and the Al electrode layer E (folded electrodes 11, separate electrodes 7, and common electrode 8) from friction generated when the head is operated. Since the thickness of the abrasion-resistance protective layer 10 is uniform, an irregular shape of the surface of the substrate is transferred on the surface of the abrasion-resistance protective layer 10, and a smooth step portion 10*a* which is processed by polishing so as to be preferably brought into contact with a print medium is provided over the insulating barrier layer 6. In FIG. 1, the abrasion-resistance protective layer 10 is not shown.

Figure 3A:
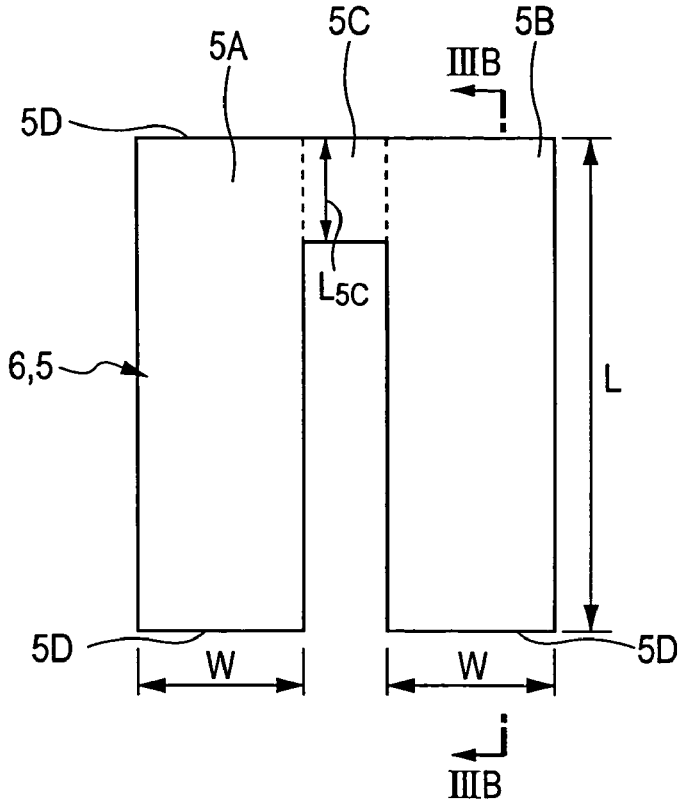
FIG. 3A is a plan view of a thermal head in process for illustrating a step of a method for manufacturing the thermal head shown in FIG. 1.

Next, with reference to FIGS. 3A to 5B, a method for manufacturing the thermal head 1 shown in FIGS. 1, 2A, 2B, and 2C will be described. FIGS. 3A, 4A, and 5A each show a plan view of a thermal head in process for illustrating a step of manufacturing the thermal head 1, and FIGS. 3B, 4B, and 5B each show a cross-sectional view of the thermal head in process shown in FIGS. 3A, 4A, and 5A, respectively.

First, over the heat storage layer 3 on the heat dissipation substrate 2, a solid resistor layer 4 and a solid insulating barrier layer 6 are sequentially formed in the same vacuum atmosphere, followed by annealing treatment. The annealing treatment is an accelerating treatment for stabilizing the resistance of the solid resistor layer 4 by applying a large thermal load beforehand. The solid resistor layer 4 is formed using a cermet material of a high melting point metal such as Ta—Si—O, TaSiONb, Ti—Si—O, or Cr—Si—O, which is likely to have a high resistance, so as to have a thickness of approximately 0.2 μm. The solid insulating barrier layer 6 is formed of an insulating material such as $SiO_2$, SiON, or SiAlON.

After the annealing treatment, a resist layer determining the planar shapes (width dimension W and the length dimensions L and $L_{5C}$) of heating resistors which are to be formed is formed on the solid insulating barrier layer 6, and part of the solid insulating barrier layer 6 and part of the solid resistor layer 4, which are not covered with the resist layer, are simultaneously removed by one dry etching step, and in addition, the resist layer is then removed. According to this dry etching step, as shown in FIG. 3A, part of the solid insulating barrier layer 6 and part of the solid resistor layer 4, which are outside the heat generating area, are all removed, and the width dimension and the length dimension of the insulating barrier layer 6 and those of the resistor layer 4 are simultaneously determined. The resistor layer 4 of this embodiment forms the planar U-shaped heating resistor 5 which has the pair of effective heating portions 5A and 5B, each having a length dimension L and a width dimension W, and the connection portion 5C having a length dimension $L_{5C}$ which connects one-end of the above adjacent effective heating portions 5A and 5B. In this case, the length dimension $L_{5C}$ of the connection portion 5C is set to 5 μm or less so as not to adversely influence the heating properties of the pair of effective heating portions 5A and 5B. In this case, by the presence of the connection portion 5C, although a recess is formed at one end of the pair of effective heating portions 5A and 5B, the recess is very shallow having a depth of approximately 0.2 μm, which is approximately equivalent to the thickness of the resistor layer 4, and hence the recess can be ignored.

Figure 3B:
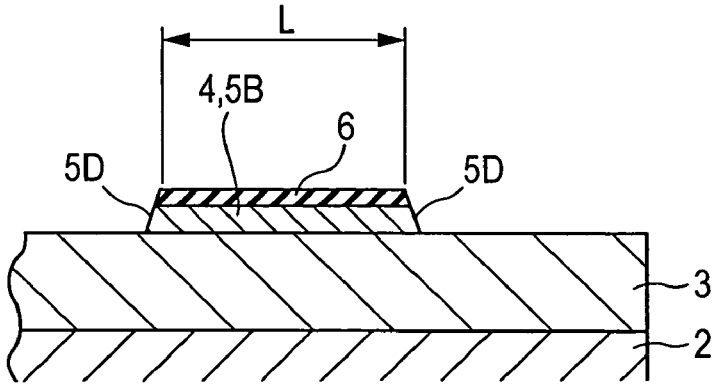
FIG. 3B is a cross-sectional view of a thermal head in process for illustrating a step of a method for manufacturing the thermal head shown in FIG. 1.
Figure 4A:
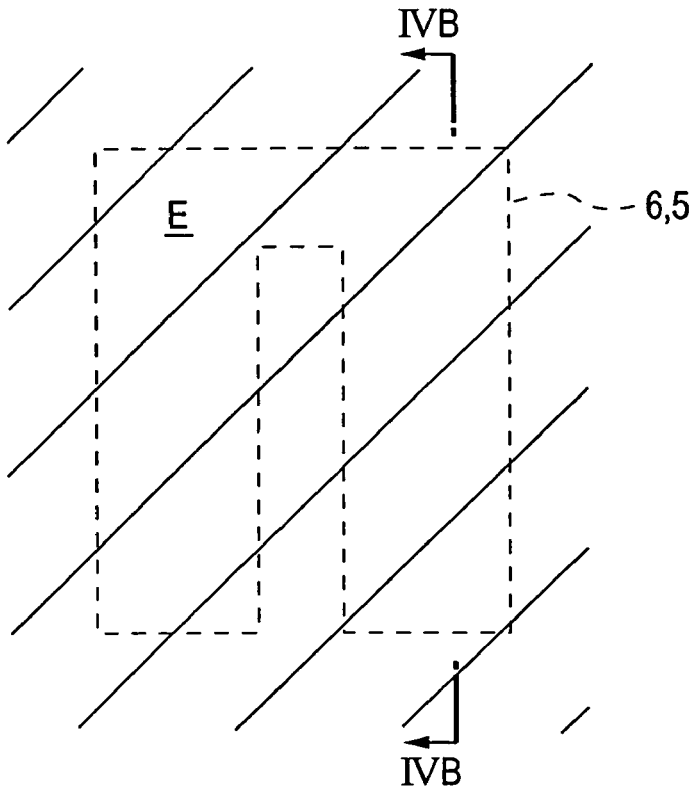
FIG. 4A is a plan view of a thermal head in process for illustrating a step following the step shown in FIG. 3A.

Furthermore, in the above dry etching step, the two end surfaces of each heating resistor 5 in the longitudinal direction are each formed to be a tapered surface 5D as shown in FIG. 3B along which the thickness of the heating resistor 5 is decreased toward the end side. When the end surfaces of the heating resistor 5 in the longitudinal direction are each the tapered surface 5D, compared to the case in which the two side surfaces are each formed to be a vertical surface perpendicular to the surface of the heat storage layer 3, a contact area with the Al Electrode layer formed in a subsequent step can be increased. According to the steps described above, the resistor layer 4 is only provided under the insulating barrier layer 6, the tapered surfaces 5D of the heating resistor 5 made of the resistor layer 4 are exposed, and the heat storage layer 3 is exposed in an area in which the solid resistor layer 4 and the solid insulating barrier layer 6 are removed.

Figure 4B:
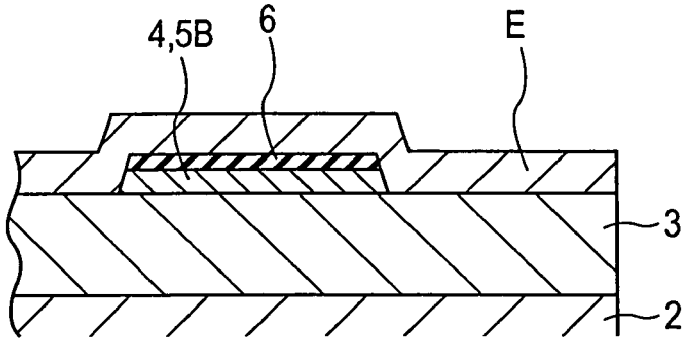
FIG. 4B is a cross-sectional view of a thermal head in process for illustrating a step following the step shown in FIG. 3B.
Figure 5A:
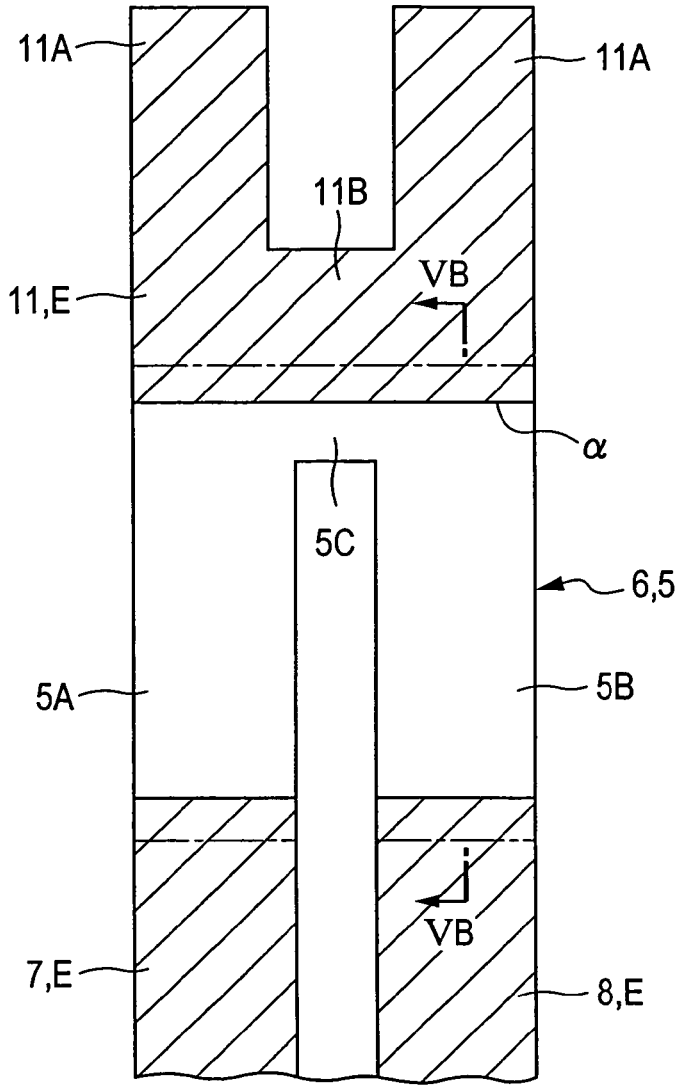
FIG. 5A is a plan view of a thermal head in process for illustrating a step following the step shown in FIG. 4A.

Subsequently, as shown in FIGS. 4A and 4B, the Al electrode layer E is formed over the insulating barrier layer 6, the exposed tapered surfaces 5D of the heating resistor 5, and the exposed heat storage layer 3. The thickness of the Al electrode layer E is preferably sufficiently increased so as to decrease the electrical resistance, and in this embodiment, the thickness is set to approximately 1 μm. In this embodiment, in a subsequent step, electrode layers including the folded electrode, the separate electrode, and the common electrode are formed from Al; however, besides Al, a conductive material such as Cr, Cu, or W may also be used.

Figure 5B:
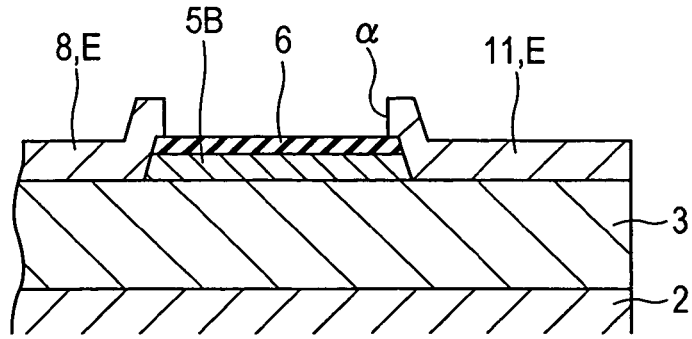
FIG. 5B is a cross-sectional view of a thermal head in process for illustrating a step following the step shown in FIG. 4B.

Next, as shown in FIGS. 5A and 5B, part of the Al electrode layer E is removed, for example, by reactive ion etching (RIE) to simultaneously form the opening portion a which exposes the insulating barrier layer 6, the separate electrode 7 which is overlaid on one side of the insulating barrier layer 6 and which is connected to the effective heating portion 5A of the heating resistor 5, the common electrode 8 which is overlaid on one side of the insulating barrier layer 6 and which is connected to the effective heating portion 5B of the heating resistor 5, and the folded electrode 11 which is overlaid on the other side of the insulating barrier layer 6 and which is connected to the effective heating portions 5A and 5B and the connection portion 5C of the heating resistor 5. In this step, the folded electrode 11 is formed to have a planar U shape facing to a side opposite to the heating resistor 5 by 180° and including the pair of parallel electrode portions 11A and the connection electrode portion 11B. The parallel electrode portions 11A, which form a pair, are overlaid on the insulating barrier layer 6 and extend in parallel with each other to the pair of effective heating portions 5A and 5B of the heating resistor 5, and the connection electrode portion 11B is also overlaid on the insulating barrier layer 6 and linearly connects edges of the parallel electrode portions 11A at the heating resistor 5 side on the connection portion 5C. In a region surrounded by the pair of parallel electrode portions 11A and the connection electrode portion 11B, a recess is formed having a depth approximately equivalent to the thickness of the folded electrode 11 (Al electrode layer E); however, since this recess is open in the feeding direction of a print medium, even when the recess is transferred on the surface of the abrasion-resistance protective layer in a subsequent step, printing damage may not be generated at all.

As described above, since the two end surfaces of the heating resistor 5 in the longitudinal direction are formed to be the tapered surfaces 5D, contact areas of the heating resistor 5 with the separate electrode 7, the common electrode 8, and the folded electrode 11 can be reliably increased, and hence electrical connection can be surely obtained. In addition, because of the above overlaid structure, even when the variation caused by etching is slightly generated, the heating resistor 5 can be reliably connected to the separate electrode 7, the common electrode 8 and the folded electrode 11.

Subsequently, in order to improve the adhesion with the abrasion-resistance protective layer formed in a subsequent step, after new surfaces of the insulating barrier layers 6, the separate electrodes 7, the common electrode 8, and the folded electrodes 11 are exposed by reverse sputtering or the like, the abrasion-resistance protective layer 10 is formed covering the insulating barrier layers 6, the separate electrodes 7 other than the electrode pads 7*a*, the common electrode 8, the folded electrodes 11, and the exposed heat storage layer 3. The abrasion-resistance protective layer 10 is formed using an abrasion-resistance material such as SiAlON or $Ta_2O_5$ to have a thickness of approximately 5 μm. An irregular shape itself of the surface of substrate including the insulating barrier layer 6, the folded electrode 11, and the like is transferred on the surface of the abrasion-resistance protective layer 10, and the step portion 10*a* corresponding to steps (step between the insulating barrier layer 6 and the folded electrode 11, and steps of the insulating barrier layer 6 with the separate electrode 7 and the common electrode 8) at the two sides of the opening portion α is formed. The depth of the step portion 10*a* is approximately 1 μm, which is approximately equivalent to the thickness of the separate electrode 7, the common electrode 8, and the folded electrode 11.

Subsequently, a rise surface forming the step portion 10*a* of the abrasion-resistance protective layer 10 is processed by polishing so as to be continuously smooth along the upper surface of the abrasion-resistance protective layer 10, and as a result, the contact between the abrasion-resistance protective layer 10 and a print medium is improved. By the steps described above, the thermal head 1 shown in FIGS. 1, 2A, 2B, and 2C can be obtained.

As has thus been described, since the part of the solid insulating barrier layer 6 and the part of the solid resistor layer 4, which are outside the heating area, are removed by one patterning (dry etching), and the width dimension W and the length dimensions L and $L_{5C}$ of the insulating barrier layer 6 and those of the resistor layer 4 are simultaneously determined, patterning deviation caused in the case in which the width dimension and the length dimension are separately determined in different steps can be eliminated, and hence the planar shape (aspect ratio of L/W) of the heating resistor 5 can be accurately determined. Accordingly, a high-performance thermal head can be obtained in which the variation in resistance between the heating resistors 5 is small. In addition, compared to the case in which the width dimension and the length dimension of the heating resistor are separately determined in different steps, the number of manufacturing steps is decreased, and as a result, the cost can also be decreased.

According to this embodiment, the heating resistor 5 has a planar U shape formed of the pair of effective heating portions 5A and 5B and the connection portion 5C, and the folded electrode 11 has a planar U shape formed of the pair of parallel electrode portions 11A and the connection electrode portion 11B. The pair of parallel electrode portions 11A extends to the pair of effective heating portions 5A and 5B of the heating resistor 5, and the connection electrode portion 11B linearly connects edges of the above parallel electrode portions 11A at the heating resistor 5 side on the insulating barrier layer 6. Hence, this folded electrode 11 will not generate a pocket recess portion closed in the feeding direction of a print medium. Between the pair of effective heating portions 5A and 5B and the connection portion 5C of the heating resistor 5, a recess is formed; however, the depth of the recess is small, such as approximately 0.2 μm, which is approximately equivalent to the thickness of the resistor layer 4, and even when the thickness of the folded electrode 11 is further increased in order to decrease the electrical resistance, the depth of the recess will not change. In addition, even when being transferred to the abrasion-resistance protective layer, the recess is not serious, and hence it can be ignored. Accordingly, dust, which is generated when the step portion 10*a* of the abrasion-resistance protective layer 10 is processed by polishing, may not remain at all on the surface of the abrasion-resistance protective layer, and as a result, printing damage caused by the above dust can be avoided.

Furthermore, according to this embodiment, since the folded electrode 11 supplies electricity to the heating resistor 5 through the tapered surface 5D thereof and is not in contact with the side surfaces of the pair of effective heating portions 5A and 5B, the effective heating portions 5A and 5B are not short-circuited via the folded electrode 11, and hence the variation in resistance of the heating resistor 5 (effective heating portions 5A and 5B) can be suppressed by preventing the generation of a leak current. In addition, since the heating resistor 5 is reliably and electrically connected to the Al electrode layer E (the separate electrode 7, the common electrode 8, and the folded electrode 11) via the tapered surfaces 5D, the variation in resistance of the heating resistor 5 can be suppressed. Furthermore, since the Al electrode layer E (the separate electrode 7, the common electrode 8, and the folded electrode 11) is formed so as to be overlaid on the insulating barrier layer 6, even when the variation is generated when etching is performed for the formation, electrical connection with the heating resistor 5 can be ensured.

Although the embodiment according to the present invention has been described in which the flat glazed head includes the heat storage layer 3 which has a uniform thickness and which is provided all over the surface of the heat dissipation substrate 2, the present invention is not limited thereto and may be applied, for example, to a partially glazed head, a real edge head, or a double glazed head.

What is claimed is:

1. A thermal head comprising:

a resistor layer generating heat when electricity is supplied thereto;

an insulating barrier layer covering the surface of the resistor layer so as to determine a planar size of a heat generating area; and an electrode layer which is overlaid on the insulating barrier layer and which supplies electricity to the resistor layer, wherein the resistor layer and the insulating barrier layer each have a planar U shape, the resistor layer is present only under the insulating barrier layer and includes a pair of effective heating portions each having a predetermined length dimension and a predetermined width dimension and a connection portion connecting the pair of effective heating portions at an end thereof, and the electrode layer includes a separate electrode and a common electrode, which are connected to said pair of effective heating portions at one end side of the resistor layer in the longitudinal direction, and also includes a folded electrode connected to said pair of effective heating portions and the connection portion at the other end side of the resistor layer in the longitudinal direction.

2. The thermal head according to claim 1, wherein the connection portion of the resistor layer has a length dimension of 5 μm or less.

3. The thermal head according to claim 1, wherein two end surfaces of the resistor layer in the longitudinal direction are each a tapered surface along which the thickness of the resistor layer is decreased toward the end side.

4. The thermal head according to claim 1, wherein the folded electrode has a planar U shape and includes a pair of parallel electrode portions, which is parallel to the pair of effective heating portions of the heating resistor and which extends onto the insulating barrier layer, and a connection electrode portion which connects edges of said pair of parallel electrode portions on the insulating barrier layer, the edges being located at the resistor layer side.

5. A method for manufacturing a thermal head, comprising the steps of:

sequentially forming a solid resistor layer and a solid insulating barrier layer over an entire surface of a heat storage layer;

patterning the solid resistor layer and the solid insulating barrier layer to form at least one resistor layer and at least one insulating barrier layer, respectively, each having a planar U shape;

forming a solid electrode layer over the insulating barrier layer and the heat storage layer; and removing part of the solid electrode layer to form at least one opening portion through which the insulating barrier layer is exposed and to form electrode layers overlaid on the insulating barrier layer at one side and the other side of the opening portion for supplying electricity to the resistor layer, wherein, in the patterning step, part of the solid resistor layer and part of the solid insulating barrier layer, which are outside a heat generating area, are simultaneously removed so as to simultaneously determine the width dimensions and the length dimensions of the resistor layer and the insulating barrier layer.

6. The method for manufacturing a thermal head, according to claim 5, wherein the resistor layer has a U shape and includes a pair of effective heating portions each having a predetermined width dimension and a predetermined length dimension and a connection portion connecting said pair of effective heating portions at an end thereof, and the length dimension of the connection portion is set to 5 μm or less.

7. The method for manufacturing a thermal head, according to claim 5, wherein, in the patterning step, two end surfaces of the resistor layer in the longitudinal direction are each formed to be a tapered surface along which the thickness of the resistor layer is decreased toward the end side.

8. The method for manufacturing a thermal head, according to claim 5, wherein, in the step of patterning the solid resistor layer and the solid insulating barrier layer, part of the solid resistor layer and part of the solid insulating barrier layer, which are outside a heating area, are simultaneously removed by dry etching.

9. The method for manufacturing a thermal head, according to claim 5, wherein the electrode layers include at least one separate electrode and at least one common electrode, which are connected to said pair of effective heating portions at one end side of the resistor layer in the longitudinal direction, and also include at least one folded electrode connected to said pair of effective heating portions and the connection portions at the other end side of the resistor layer in the longitudinal direction, and the folded electrode has a planar U shape and includes a pair of parallel conductive portions, which is parallel to said pair of effective heating portions of the heating resistor and which extends onto the insulating barrier layer, and an electrode which connect said pair of parallel conductive portions at least on the insulating barrier layer.

* * * * *